US007315721B2

(12) United States Patent
Kitayama

(10) Patent No.: US 7,315,721 B2
(45) Date of Patent: Jan. 1, 2008

(54) IMAGE FORMING AND FIXING APPARATUS WITH COOLING FAN

(75) Inventor: Kunihiko Kitayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/530,552

(22) Filed: Sep. 11, 2006

(65) Prior Publication Data

US 2007/0059024 A1 Mar. 15, 2007

(30) Foreign Application Priority Data

Sep. 12, 2005 (JP) ..... 2005-263634

(51) Int. Cl.
*G03G 15/20* (2006.01)

(52) U.S. Cl. ..... 399/320; 399/322; 399/92; 399/68

(58) Field of Classification Search ..... 399/68, 399/92, 102, 322, 401, 405, 406; 271/303; 454/184

See application file for complete search history.

(56) References Cited

U.S. PATENT DOCUMENTS 4,910,560 A * 3/1990 Kanada ..... 399/343
6,108,514 A * 8/2000 Nakayama et al. ..... 399/400
6,259,871 B1 * 7/2001 Rider et al. ..... 399/92
2006/0056895 A1 * 3/2006 Mizuno et al. ..... 399/406
2006/0133865 A1 * 6/2006 Nakamura et al. ..... 399/320

FOREIGN PATENT DOCUMENTS

| | | | |
|---|---|---|---|
| JP | 5-341601 | | 12/1993 |
| JP | 05341601 | A * | 12/1993 |
| JP | 9-34321 | | 2/1997 |
| JP | 09034321 | A * | 2/1997 |
| JP | 11-352840 | | 12/1999 |
| JP | 11352840 | A * | 12/1999 |
| JP | 2001-255807 | | 9/2001 |
| JP | 2001255807 | A * | 9/2001 |
| JP | 2003-255809 | | 9/2003 |
| JP | 2003255809 | A * | 9/2003 |

* cited by examiner

*Primary Examiner*—David M. Gray
*Assistant Examiner*—Kristofferson Service
(74) *Attorney, Agent, or Firm*—Fitzpatrick, Cella, Harper & Scinto

(57) ABSTRACT

An image forming apparatus comprises an image forming unit for forming a toner image on a sheet, a fixing unit for fixing the toner image transferred on the sheet by heat, a cooling fan for cooling the sheet by supplying air to the sheet fixed by the fixing unit and an oscillating member. The oscillating member has a flat portion formed at the leading end side and shields the flow of air supplied by the cooling fan into the fixing unit.

5 Claims, 6 Drawing Sheets

IMAGE FORMING AND FIXING APPARATUS WITH COOLING FAN

BACKGROUND OF THE INVENTION

1. Field of the Invention

The invention relates to an image forming apparatus.

2. Description of the Related Art

Various modes can be set, hitherto, in image forming apparatus operating on electrophotographic system such as color copying machines and color printers. Specific modes include color, monochromatic, color-monochromatic hybrid, one-side copy, two-side copy, face-down (FD) discharge for discharging the print side down, and face-up (FU) discharge for discharging the print side up.

Such image forming apparatus is shown in FIG. 1. As shown in FIG. 1, the image forming apparatus includes a rotatable photosensitive drum 1 as an image bearing member. A charging roller 2 is disposed above the photosensitive drum 1. The charging roller 2 is a roller for uniformly charging the surface of the photosensitive drum 1.

A laser unit 3 is writing means, which forms an electrostatic latent image by selectively exposing the surface of the photosensitive drum 1 depending on image signal. At the left side of the photosensitive drum 1, a development unit 4 is provided as developing means. The development unit 4 is a device for rendering the electrostatic latent image into a sensible image by using a toner.

The development unit 4 consists of four units 5Y, 5M, 5C, SK containing toners of four colors, yellow, magenta, cyan, and black, respectively. Three development units 5Y, 5M, 5C out of four units 5Y, 5M, 5C, 5K are provided in a rotary development device 6.

The color development units 5Y, 5M, 5C provided in the rotary development device 6 sequentially face the photosensitive drum 1, and develop. Then, the black development unit 5K always sitting oppositely to the photosensitive drum 1 operates and develops.

An intermediate transfer belt 7 is provided beneath the photosensitive drum 1. On the intermediate transfer belt 7, sensible toner images developed by the color development units are sequentially transferred by a primary transfer unit T1, and multiple transferred toner images are formed on the surface.

A sheet P is supplied onto a registration roller 8 from a feed unit The sheet P waiting on the registration roller 8 is sent into a secondary transfer unit T2 in synchronism with the toner image on, the intermediate transfer belt 7.

The secondary transfer roller 9 is movable to contact with or depart from the intermediate transfer belt 7. The secondary transfer roller 9 is apart during multiple transfer process by the intermediate transfer belt 7, and is in contact during secondary transfer process. By this contacting motion, the toner image is transferred on the sheet P by the secondary transfer unit T2.

The toner image carried on the sheet P is heated and pressed by a fixing roller 10, and is fixed on the sheet P. Then, the sheet P on which the toner image is formed is discharged on a discharge tray 26 by a discharge roller 17.

The discharge unit includes a flapper 16, a discharge flapper 21, an inversion flapper 22, and a motor (not shown) changeable in rotating direction. By these flappers 16, 21, 22 and motor, the conveying path and conveying direction can be changed over, and it is applicable to various modes, including one-side and two-side print, FU discharge, and FD discharge.

In the image forming apparatus having such configuration, hitherto, cooling means such as a fan is used to lower the temperature in the product main body. To cool the area around the fixing roller 10 which releases mass of heat structurally or the photosensitive drum 1 which is delicate to high heat, an exhaust fan 13 is installed to force out the heated air.

Recently, the quality is much enhanced in a printer and a copying machine, and it is demanded to form images on a thick coated paper. In the conventional structure, when forming an image on thick coated paper, heat capacity of thick coated paper is very large, the sheet is heated by the fixing roller, and conveyed into the discharge unit in very hot state.

As shown in FIG. 6, the toner is not fixed on the sheet, and the soft toner contacts with the conveying roller or rib 18 of paper conveying guide disposed in the conveying path, and roller marks and rib marks are formed, and uneven gloss occurs. Besides, since a hot sheet is discharged, the soft toner plays the role of an adhesive, and the sheets are stuck together on the discharge tray in a worst case.

Accordingly, it has been proposed to cool the sheet and harden the toner by blowing air drawn from outside of the product on the sheet before the sheet contacts with the conveying roller or conveying guide, or before it is discharged into the discharge tray (see Japanese Patent Application Laid-Open (JP-A) No. 11-352840).

However, in the technology disclosed in JP-A No. 11-352840, by installing a sheet cooling fan in the discharge unit, undesired air flow may be formed in the image forming apparatus. That is, the air for cooling the sheet is desired to be low in temperature. Accordingly, instead of inside air of product high in temperature, air outside of product is taken in and blown to the sheet.

Thus, the sheet cooling fan draws air from outside of the apparatus main body, resulting in positive pressure air in the discharge unit. As a result, air around the fixing unit adjacent the discharge unit enters into the image forming unit.

As a result, heat of the fixing roller controlled around 200 C. is transmitted to the image forming unit, and the temperature of image forming unit is elevated. In particular, if the transfer cleaner often installed near the fixing unit is raised in temperature, the temperature of transfer cleaner may exceed the softening point of toner (50 to 60 C.), and toner clogging may occur. By toner clogging, waste toner may not be collected in the cleaner. Finally, the toner overflows and stains the image.

This problem becomes more serious when a plurality of fans is installed for cooling the sheets, or a large volume of air is used for cooling the sheets. Or if the exhaust of air supplied form the discharge cooling fan is directed toward the fixing roller, the fixing roller is cooled. As a result, the duty of fixing heater becomes high, and the power consumption is increased.

SUMMARY OF THE INVENTION

It is hence an object of the invention to prevent cooling of fixing unit by air, or to prevent temperature elevation of image forming unit due to hot air sent from the fixing unit to the image forming unit.

An image forming apparatus comprising: an image forming unit for forming a toner image on a sheet; a fixing unit for fixing the toner image transferred on the sheet by heat; a first conveying path provided at the downstream side of the fixing unit for conveying the sheet on which the toner image is fixed; a cooling fan for cooling the sheet by supplying air to the sheet conveyed in the first conveying path; a second conveyance path diverging from the first conveyance path at a diverging portion provided on an upstream side of the cooling fan; and an oscillating member provided on the diverging portion for changing over the first conveying path and the second conveying path on which the sheet is conveyed, wherein the oscillating member has a flat portion formed at the leading end side, wherein the oscillating member shields the flow of air supplied by the cooling fan into the fixing unit by way of the first conveying path.

Further, An image forming apparatus comprising: a fixing unit for fixing a toner image transferred on a sheet to the sheet by heat; a guide unit for forming a conveying path by guiding the sheet on which the image is fixed by the fixing unit; an opening formed in the guide unit; a fan for generating an air flow to be sent into the conveying path through the opening; and a moving member movably provided between the opening and the fixing unit in the conveying path, wherein the moving member has a flat portion formed at the leading end side, wherein the moving member moves to a position for closing the conveying path, and thereby the moving member prevents the air generated by the fan from flowing to the fixing unit.

An image forming apparatus comprising: an image forming unit for forming a toner image on a sheet; a fixing unit for fixing the toner image transferred on the sheet by heat; a first conveying path provided at the downstream side of the fixing unit for conveying the sheet on which the toner image is fixed; a cooling fan for cooling the sheet by supplying air to the sheet conveyed in the first conveying path; a second conveyance path diverging from the first conveyance path at a diverging portion provided on an upstream side of the cooling fan; an oscillating member provided on the diverging portion for changing over the first conveying path and the second conveying path on which the sheet is conveyed; and a sealing member sealing between a shaft portion of the oscillating member and an opposite member opposite to the shaft portion.

Further features of the present invention will become apparent from the following description of exemplary embodiments (with reference to the attached drawings).

DESCRIPTION OF THE EMBODIMENTS

Figure 1:
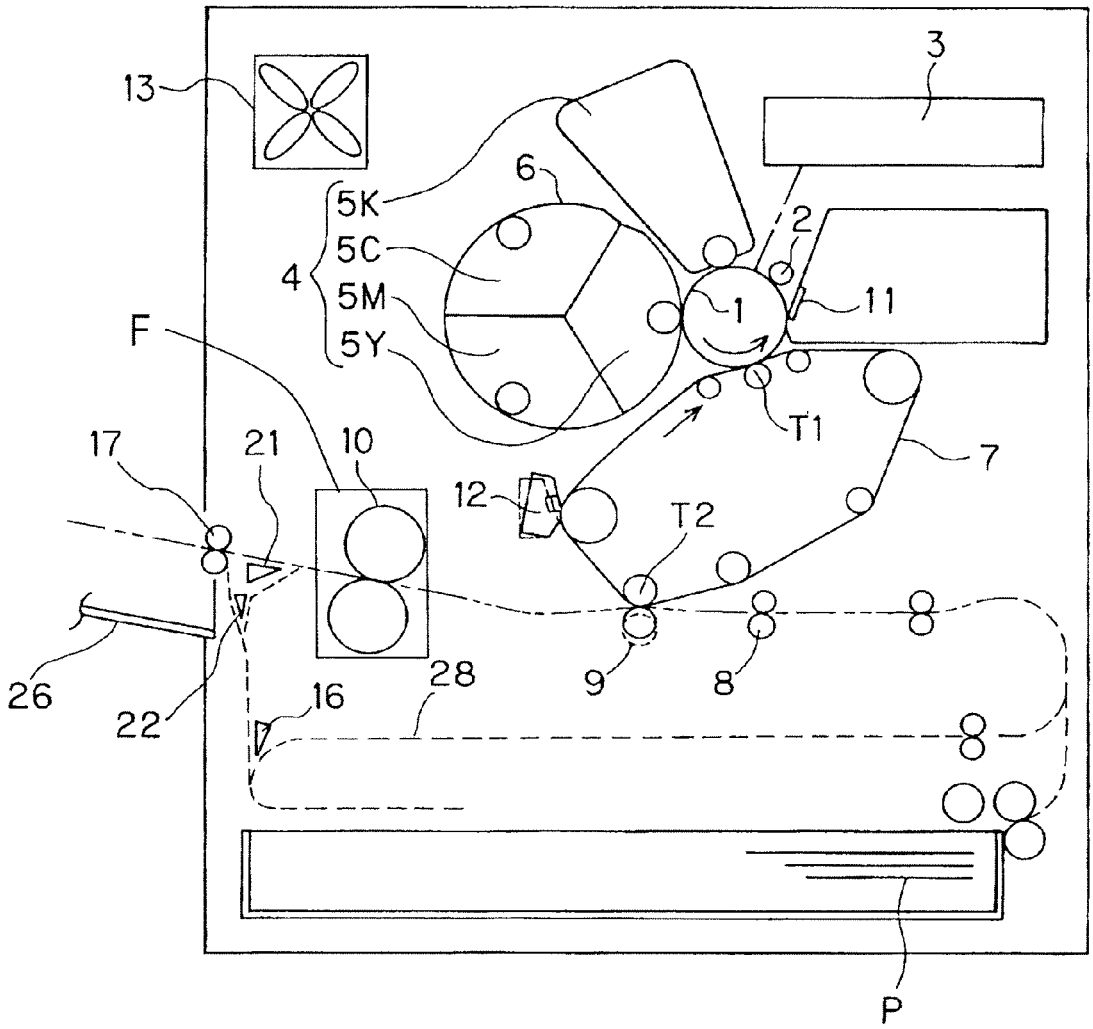
FIG. 1 is a sectional view of structure of image forming apparatus.

Preferred embodiments of the invention are described below while referring to accompanying drawings. Throughout the drawings, the same or corresponding parts are identified with the same reference numerals

First Embodiment (Image Forming Apparatus)

FIG. 1 shows an image forming apparatus, in which cooling means of the first embodiment is applicable. As shown in FIG. 1, the image forming apparatus includes a photosensitive drum 1, which is provided rotatably as an image bearing member forming a part of image forming means. Above the photosensitive drum 1, a charging roller 2 is disposed as part of image forming means. The charging roller 2 is a roller for charging uniformly the surface of photosensitive drum 1.

A laser unit 3 as part of image forming means selectively exposes the surface of photosensitive drum 1 depending on image signal, and forms an electrostatic latent image. At the left side of the photosensitive drum 1, a development unit 4 is provided as developing means. The development unit 4 is a device for rendering the electrostatic latent image into a sensible image by using a toner.

The development unit 4 as a part of image forming means consists of four development units 5Y, 5M, 5C, 5K containing toners of four colors, yellow, magenta, cyan, and black, respectively. Three development units 5Y, 5M, 5C out of four development units 5Y, 5M, 5C, 5K are provided in a rotary development device 6 as part of image forming means.

The color development units 5Y, 5M, 5C provided in the rotary development device 6 sequentially face the photosensitive drum 1, and develop. Then, the black development unit 5K always sitting oppositely to the photosensitive drum 1 operates and develops.

An intermediate transfer belt is provided beneath the photosensitive drum 1 as intermediate transfer unit. Sensible toner images developed by the color development units are sequentially transferred on the surface of the intermediate transfer belt 7 by a primary transfer unit T1, and multiple transferred toner images are formed on the surface of the intermediate transfer belt 7.

A sheet P is supplied onto a registration roller 8 from a feed unit. The sheet P waiting on the registration roller 8 is sent into a secondary transfer unit T2 in synchronism with the toner image on the intermediate transfer belt 7.

The secondary transfer roller 9 is secondary transfer means, and is movable to contact with or depart from the intermediate transfer belt 7. It is apart during multiple transfer process by intermediate transfer belt 7, and is in contact during secondary transfer process. The toner image is transferred on the sheet P by the secondary transfer unit T2.

The image forming unit of the embodiment for forming an image on a sheet consists of photosensitive drum 1, charging roller 2, laser unit 3, development unit 4, intermediate transfer belt 7, and secondary transfer roller 9.

The toner image carried on the sheet P is heated by a fixing unit F as fixing means, and is fixed on the sheet P. The fixing unit F has a fixing roller 10. The toner image carried on the sheet P is heated and pressed by the fixing roller 10 and is fixed on the sheet P. Then the sheet P on which the toner image is formed is discharged on a discharge tray 26 by a discharge roller pair 17.

The discharge unit includes a flapper 16, a discharge flapper 21, an inversion flapper 22, and motor (not shown) changeable in rotating direction. By these flappers 16, 21, 22 and motor, the conveying path and conveying direction can be changed over, and it is applicable to various modes, including one-side and two-side print, FU discharge, and FD discharge. Herein, FU discharge is face-up discharge for discharging the sheet to discharge tray 26 with the image side up, and FD discharge is face-down discharge for discharging the sheet to discharge tray 26 with the image side down.

(Discharge Unit)

Figure 2:
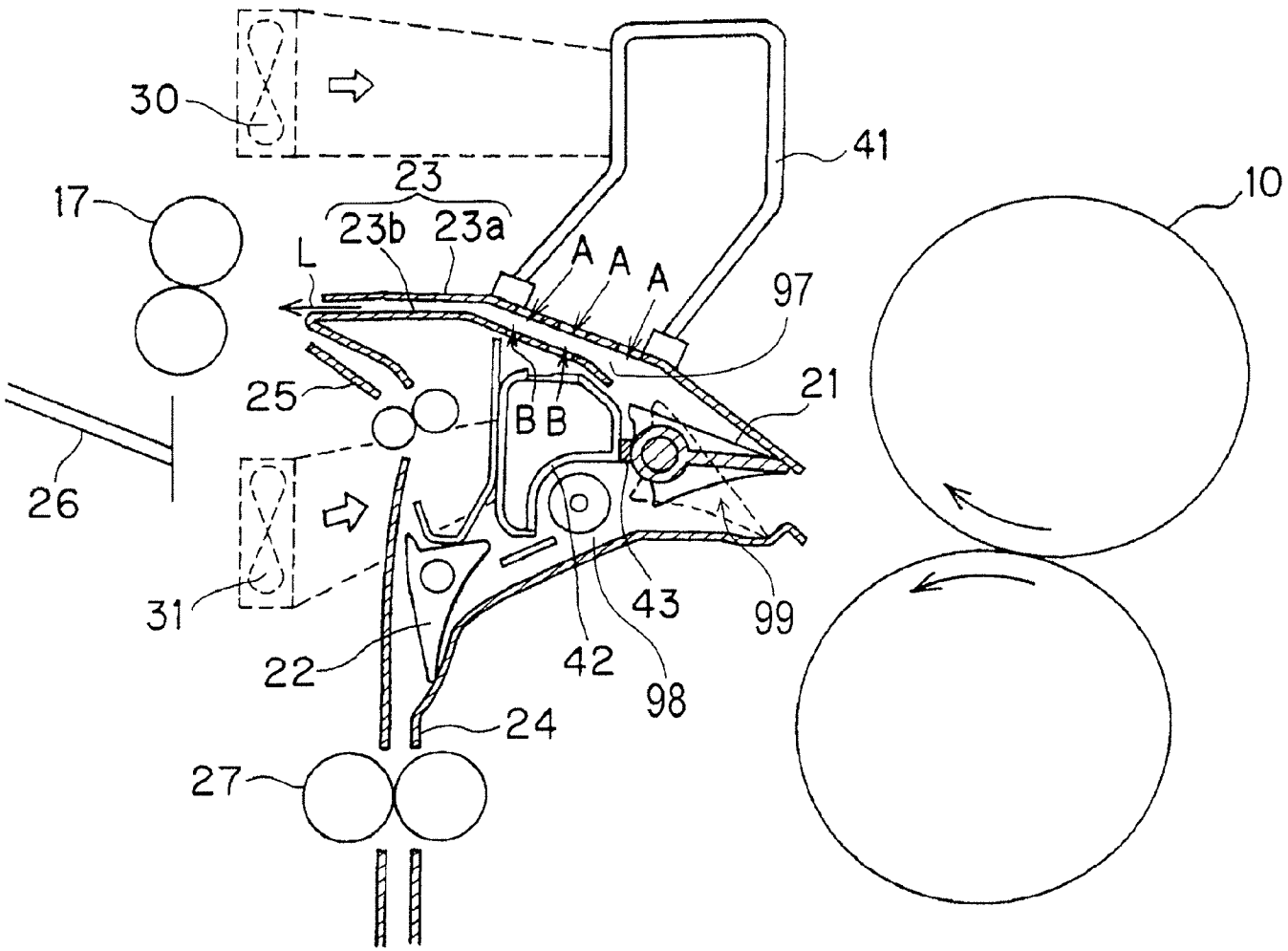
FIG. 2 is a sectional view of configuration of an embodiment of the invention.

FIG. 2 shows the discharge unit of the first embodiment of the invention. A second conveyance path 98 formed by the inversion vertical path guide 24 diverges from the first conveyance path 97 formed by discharge guide 23 at a diverging portion 99. As shown in FIG. 2, the discharge flapper 21 is a device, as an oscillating member, for changing over the discharge guide 23 and the inversion vertical path guide 24 as a plurality of conveying paths. The discharge flapper 21 is rotated by solenoid (not shown) as driving means. An inversion roller 27 is a roller rotating normally and reversely, and is designed to change the conveying direction between the direction of the two-side path and the direction of inversion sheet discharge guide 25. The discharge flapper 21 changes over the first conveying path 97 formed by discharge guide 23 and second conveying path 98 formed by the inversion vertical path guide 24 on which the sheet is conveyed.

In the case of FU discharge, the sheet is conveyed as follows. The sheet first passes the upper side of the discharge flapper 21, and discharged into the discharge tray 26 with the image forming side up.

In the case of FD discharge, the discharge flapper 21 is moved to the position indicated by the solid line in FIG. 2. The sheet passes the lower side of the inversion flapper 21, and the inversion flapper 22 forced in counterclockwise direction by spring (not shown) is forced out by the leading end of the sheet. After the trailing end of the sheet passes through the inversion flapper 22 the inversion roller 27 is inverted, and the conveying direction is switched back to the direction of inversion discharge guide 25, and the sheet is discharged to the discharge tray 26 with the image forming side down after passing the left side of the inversion flapper 22.

In the case of two-side output, the sheet printed on one side only passes the lower side of the discharge flapper 21 by changeover of the discharge flapper 21, and inverted for printing on other side, and is supplied into the two-side path. The sheet printed on two sides is discharged onto the discharge tray 26 by passing the upper side of the discharge flapper 21 by changeover of the discharge flapper 21.

In the first embodiment, in order to eliminate uneven gloss due to conveying rollers disposed in the discharge unit regardless of the output mode, a plurality of cooling fans is disposed in conveying paths. Hence, deterioration of image quality can be prevented securely and efficiently.

In one-side FU discharge, a discharge upper fan 30 is provided as cooling means for cooling the sheet in the process of the sheet being guided by the discharge guide 23. In two-side output, in the process of the sheet being guided by the discharge guide 23, the discharge upper fan 30 for cooling the upper side, and a discharge lower fan 31 as cooling means for cooling the lower side are provided. In the discharge upper fan 30 and discharge lower fan 31 as discharge cooling fan, full speed driving, half speed driving, and stopping are changed over by control means provided in the image forming apparatus.

The discharge guide 23 is composed of a discharge upper guide 23*a* and a discharge lower guide 23*b*, and discharge cooling fan ducts 41, 42 are provided above and beneath the guides. Openings are formed in the discharge upper guide 23*a* and discharge lower guide 23*b*, and air from the fan duct is blown to the sheet. After passing through the fixing roller 10, the sheet P is conveyed through the conveying path formed by the discharge guide 23.

Figure 3:
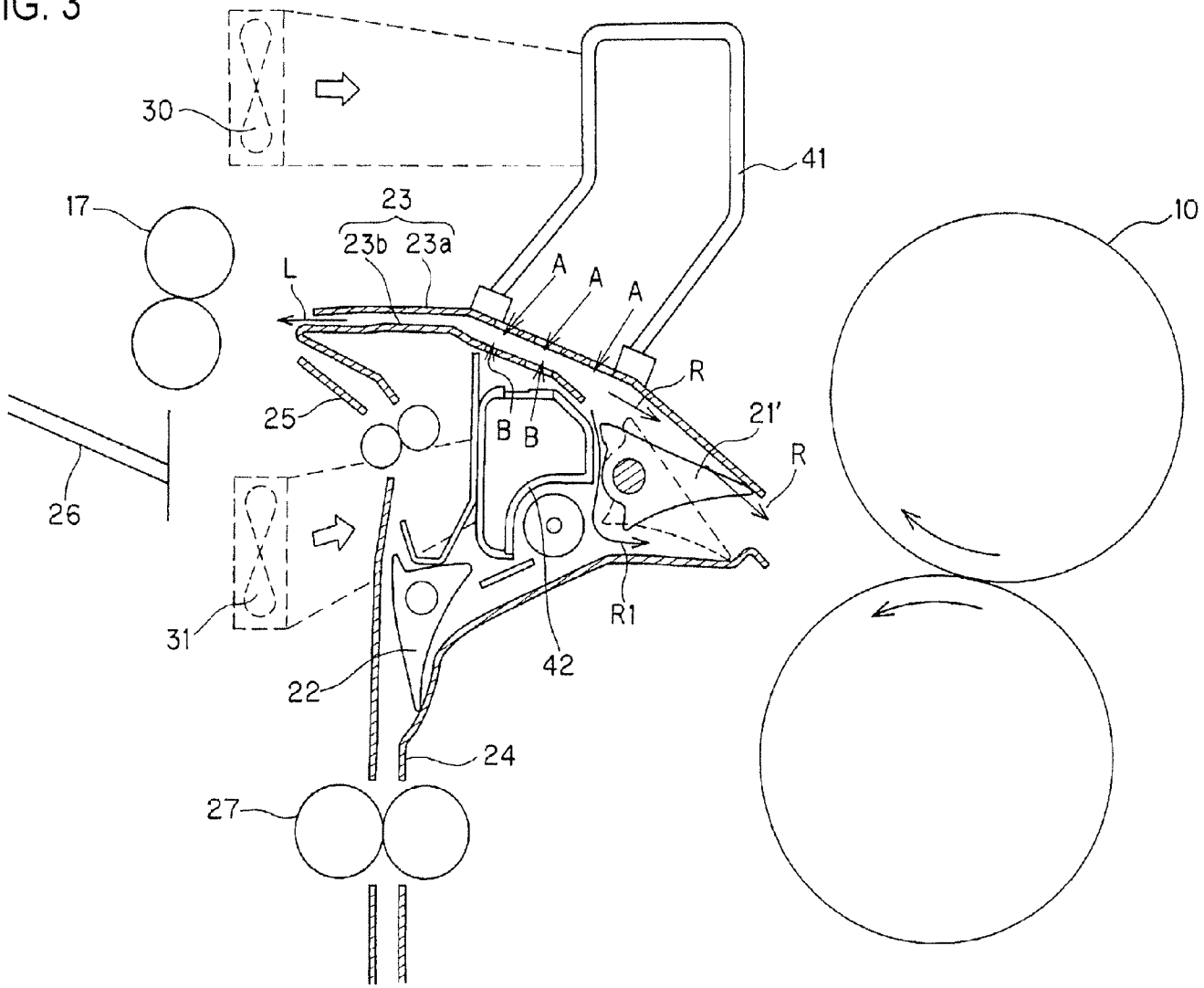
FIG. 3 is a sectional view for explaining problems of air flow in image forming apparatus in related art.
Figure 4:
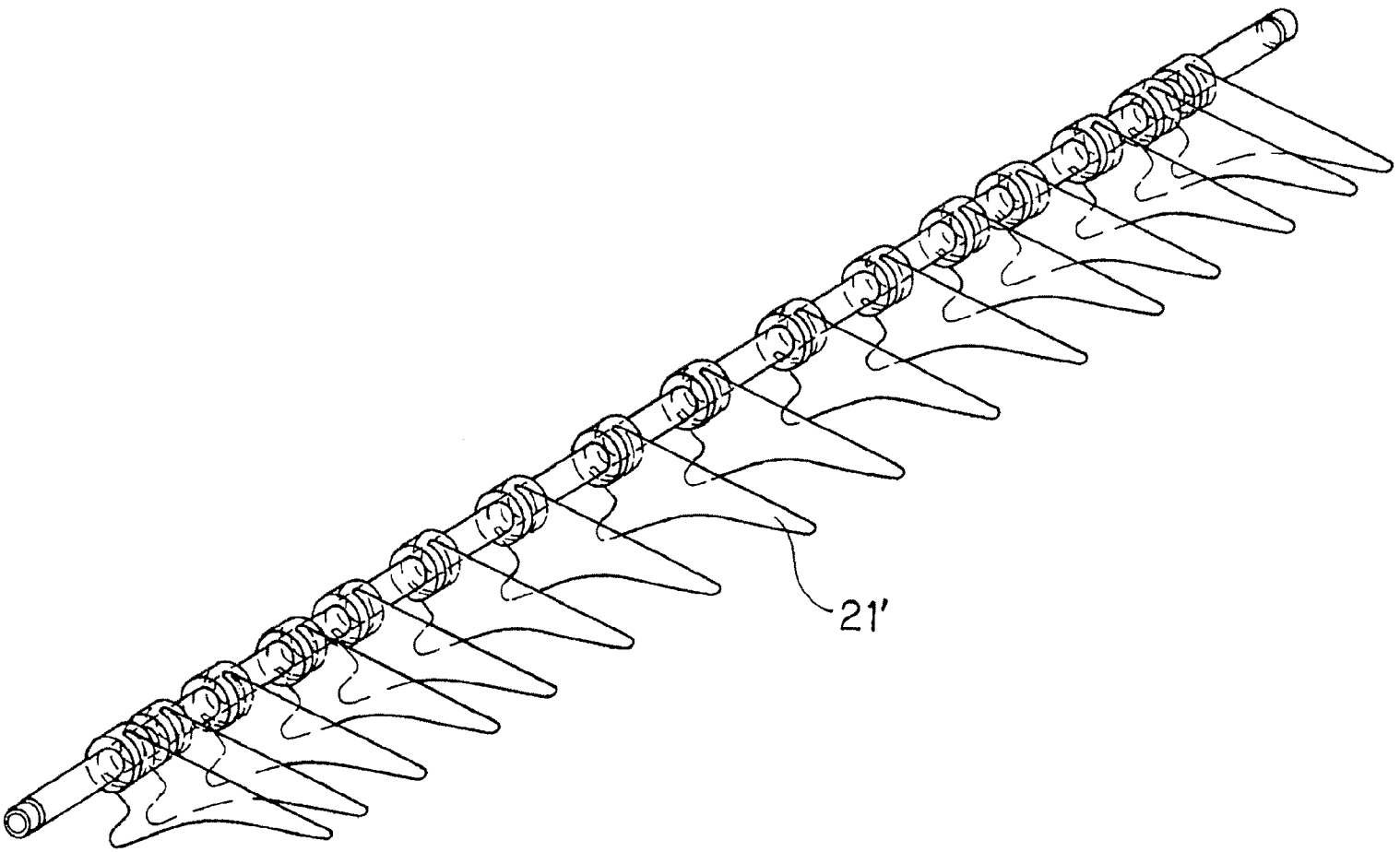
FIG. 4 is a perspective view of flapper in image forming apparatus in related art.

FIG. 3 shows an air flow in related art. In FIG. 2 and FIG. 3, arrows A and B indicate the flow of air blown to sheet. The air supplied into the conveying path formed by upper and lower discharge guides is exhausted to the upstream side and downstream side of conveying path as indicated by arrows L and R. Exhaust air flowing into the downstream side of guide is directly forced out of the apparatus. On the other hand, exhaust air flowing into the upstream side of guide passes through between pawls of pawl type flapper 21', and is directed toward the fixing roller. FIG. 4 shows the shape of flapper 21' of pawl type.

The inventor intensively experimented and studied about exhaust air, and obtained knowledge about exhaust air. According to the knowledge of the inventor, when exhaust air is blown directly to the fixing roller 10, the fixing roller 10 is cooled, and the duty of fixing heater 10 becomes high, and the power consumption is increased. Further, the fixing roller 10 is deprived of heat, and the heated air flows into the image forming unit, and the image forming unit is elevated in temperature.

As a result of intense investigations by the inventor, to prevent temperature elevation of image forming unit, it is found effective to prevent the exhaust air from hitting the fixing roller 10 directly. By further experiments and studies by the inventor, it is found effective to use air shielding means to prevent the exhaust air towards the fixing roller 10 from hitting the image forming unit directly, and therefore the exhaust air in the exhaust route is cooled, and temperature elevation of image forming unit can be suppressed. The air shielding means is described below.

As shown in FIG. 2, the discharge flapper 21 in the embodiment is a flapper with a nearly straight and flat leading end. When this flat flapper contacts with the discharge upper guide 23*a*, air flow to the fixing unit F direction is shielded. Since the discharge flapper 21 is a flat flapper, air flow in arrow R direction shown in FIG. 3 is shielded, and the heated exhaust air is prevented from hitting the image forming unit directly.

Figure 5:
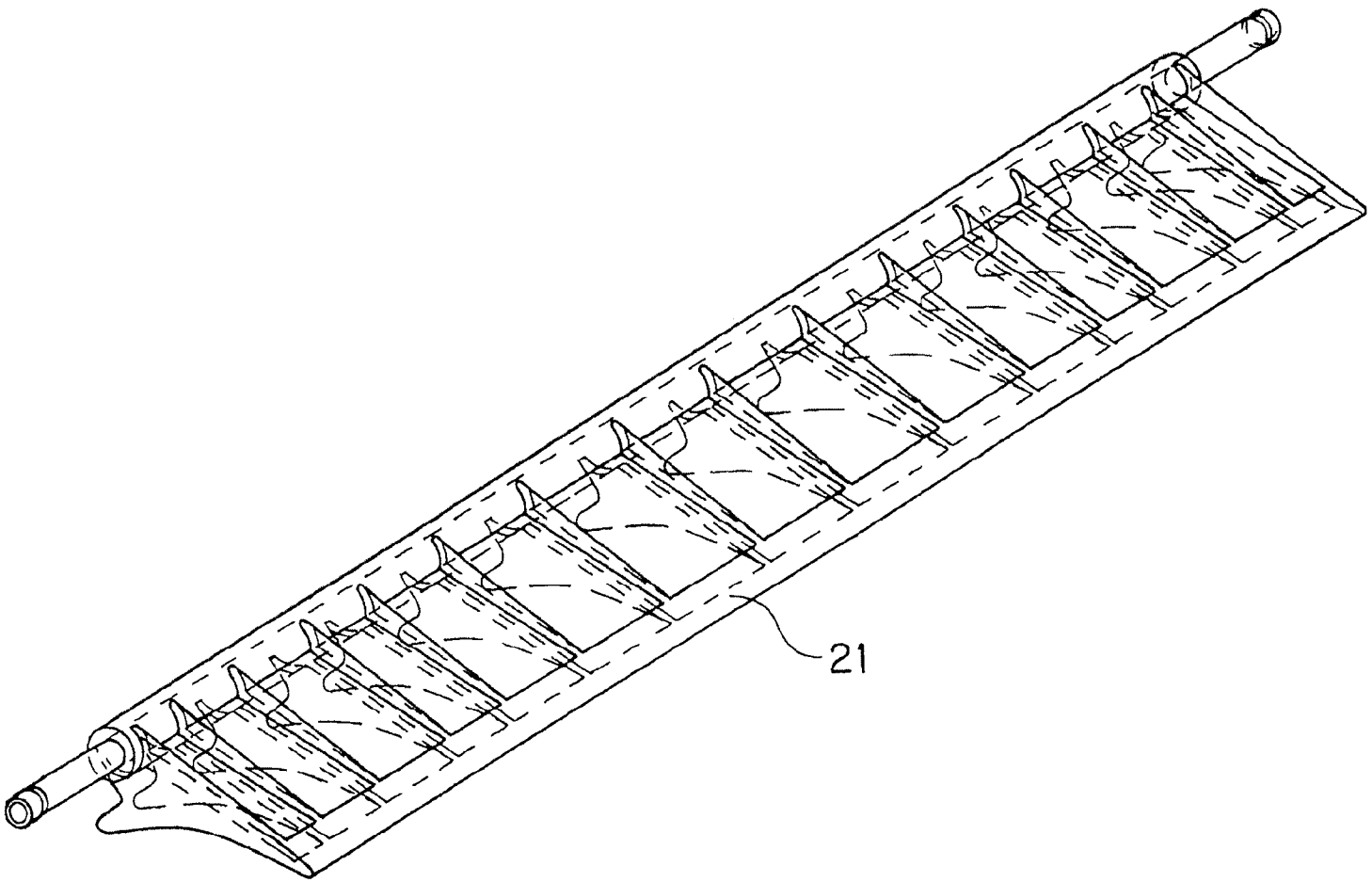
FIG. 5 is a perspective view of flapper in an embodiment of the invention.
Figure 6:
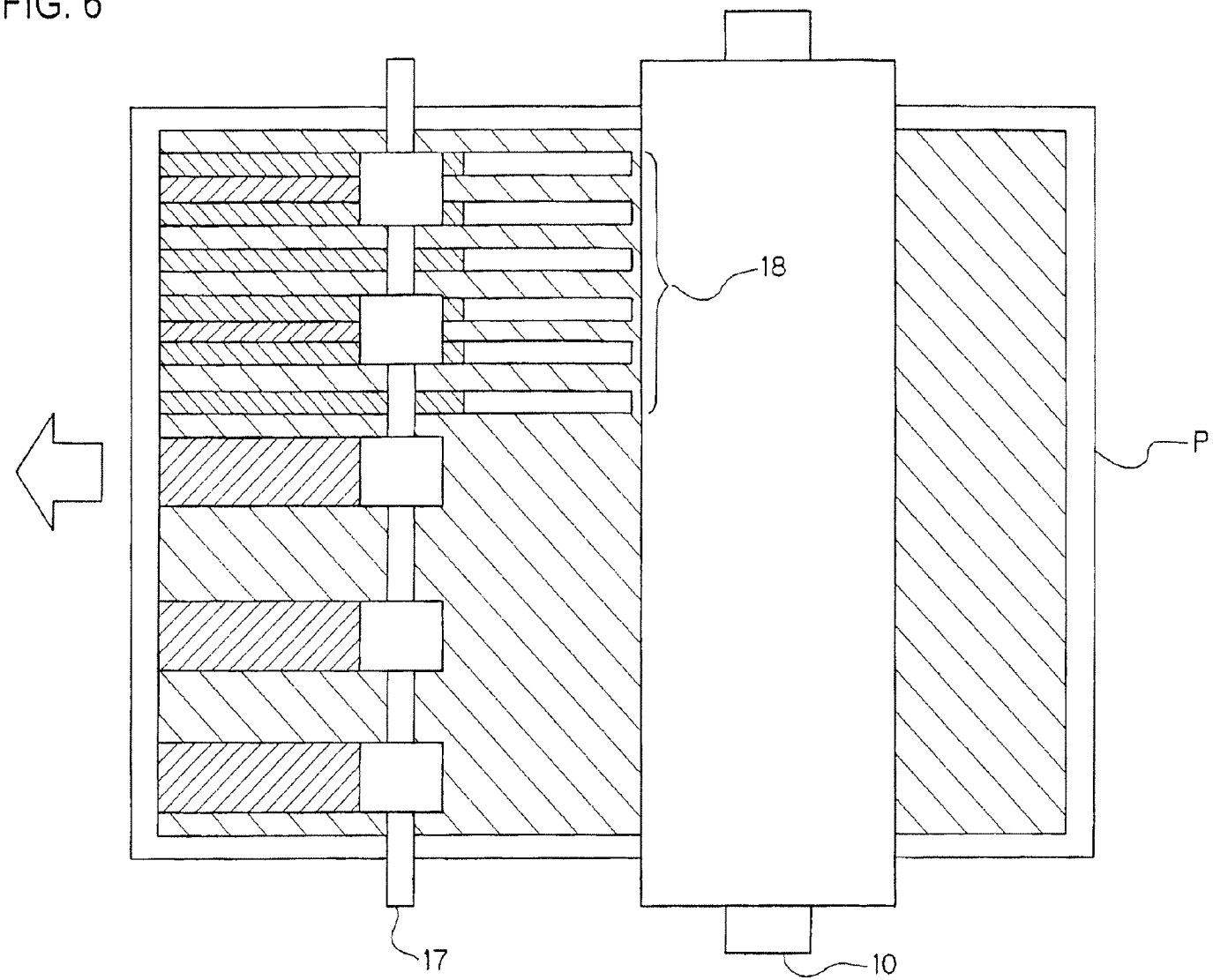
FIG. 6 is a schematic diagram explaining the problems about image in sheet discharge unit in related art.

The discharge flapper 21 has a nearly straight leading end as shown in FIG. 5, with a flat portion formed at the leading end side. When the leading end of discharge flapper 21 and the discharge upper guide 23*a* contact with each other, flow of air supplied in the conveying path from the discharge upper fan 30 and discharge lower fan 31 into the fixing roller 10 is shielded. That is, the discharge flapper 21 functions also as shielding member for shielding the conveying path for preventing the air supplied in the conveying path from the discharge upper fan 30 and discharge lower fan 31 from flowing into the fixing unit F.

The discharge upper fan 30 and the discharge lower fan 31 supply air for cooling the discharge guide 23 even while the sheet is not conveyed in the conveying path formed by the discharge guide 23. Cooling of discharge guide 23 is intended to prevent the toner from melting due to contact of heated discharge guide 23 with the sheet. While the sheet is not conveyed in the conveying path formed by the discharge guide 23, it is the time, for example, while the sheet is being conveyed to the inversion vertical path guide 24 for sheet inversion, or the waiting time not conveying sheet. In the embodiment, for FU discharge (for guiding the sheet into the conveying path formed by the discharge guide 23), the discharge flapper 21 is moved to the solid line position in FIG. 2 and shields the flow of air in the conveying path, except when moving the discharge flapper 21 to the dotted line position in FIG. 2.

FIG. 5 shows discharge flapper 21 as shielding means composed of flat flapper. As shown in FIG. 5, by the blank shape of discharge flapper 21, that is, by forming an air seal member between the flapper shaft and the opposite member, load in operation can be lessened, and quick changeover is realized. The flapper may be also composed by adhering a sheet to a plurality of pawls.

Structure for reinforcing air shielding is explained. As indicated by arrow R1 in FIG. 3, according to the related art, air leaks from the flapper shaft can flows towards the fixing roller 10. In order to shield the air, a seal member 43 is provided, as shown in FIG. 2, between the lower side exhaust duct and the shaft of the discharge flapper 21. The seal member is a flexible member such as foamed polyurethane adhered to the duct side. To avoid disturbance of rotating motion of flapper, it is preferred to adhere sliding member such as polyethylene terephthalate (PET) on the surface of seal.

The discharge upper fan 30 and the discharge lower fan 31 supply air for cooling the discharge guide 23 even while the sheet is not conveyed in the conveying path formed by the discharge guide 23. Cooling of discharge guide 23 is intended to prevent the toner from melting due to contact of heated discharge guide 23 with the sheet. While the sheet is not conveyed in the conveying path formed by the discharge guide 23, it is the time, for example, while the sheet is being conveyed to the inversion vertical path guide 24 for sheet inversion, or the waiting time not conveying sheet. In the embodiment, for FU discharge (for guiding the sheet into the conveying path formed by the discharge guide 23), the discharge flapper 21 is moved to the solid line position in FIG. 2 and shields the flow of air in the conveying path, except when moving the discharge flapper 21 to the dotted line position in FIG. 2.

As explained herein, the image forming apparatus of the embodiment has cooling means for cooling the sheet in the discharge unit after passing through the fixing device. The image forming apparatus also includes air shielding means for preventing air supplied from cooling means from flowing into the fixing means. It is also effective to prevent temperature elevation in image forming unit due to flow of hot air supplied from fixing means into image forming means. Besides, toner clogging and other problems in the transfer cleaner unit can be avoided, and exhaust air from cooling means is not supplied directly into the fixing means, and wasteful power consumption due to cooling of fixing means can be avoided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-263634, filed on 12 Sep. 2005, which is hereby incorporated by reference herein in its entirety.

What is claimed is:

1. An image forming apparatus comprising:

an image forming unit configured to form a toner image on a sheet;

a fixing unit configured to fix the toner image on the sheet by heat;

a conveying path in which the sheet on which the toner image was fixed by the fixing unit passes, wherein the conveying path diverges in a first direction and a second direction at a diverging portion and has a first conveying path in which a sheet conveyed in the first direction passes and a second conveying path in which a sheet conveyed in the second direction passes;

a cooling fan configured to supply air into the first conveying path so as to cool the sheet in the first conveying path;

a movable guiding member provided on the diverging portion for guiding a sheet, wherein the guiding member moves between a first position for guiding a sheet to the first conveying path and a second position for guiding a sheet to the second conveying path wherein the guiding member can prevent the air which has been supplied into the first conveying path by the cooling fan from flowing into the fixing unit by way of the conveying path.

2. The image forming apparatus of claim 1, further comprising:

a member for forming the conveying path, wherein when the sheet is not conveyed on the first conveying path, the leading end of the movable guiding member moves to the second position contacting with the member, and thereby the movable guiding member prevents the air which has been supplied by the cooling fan from flowing into the fixing unit by way of the conveying path.

3. The image forming apparatus of claim 1, further comprising:

a sealing member sealing between a shaft portion of the movable guiding member and an opposite member opposite to the shaft portion.

4. The image forming apparatus of claim 1, further comprising a member for forming the conveying path, wherein the movable guiding member has a flat portion formed at the leading end side, and wherein the flat portion of the movable guiding member contacts with the member, and thereby the movable guiding member prevents the air which has been supplied by the cooling fan from flowing into the fixing unit by way of the conveying path.

5. The image forming apparatus of claim 1, further comprising a member for forming the conveying path, wherein the movable guiding member extends in a width direction crossing a sheet conveying direction and has a continuous portion on the edge, and the continuous portion contacts with the member so that the sheet conveying path is shut.

* * * * *

UNITED STATES PATENT AND TRADEMARK OFFICE

CERTIFICATE OF CORRECTION

PATENT NO. : 7,315,721 B2
APPLICATION NO. : 11/530552
DATED : January 1, 2008
INVENTOR(S) : Kitayama It is certified that error appears in the above-identified patent and that said Letters Patent is hereby corrected as shown below:

COLUMN 1:
Line 46, “unit” should read --unit.--.
Line 48, “on,” should read --on--.

COLUMN 2:
Line 51, “form” should read --from--.

COLUMN 3:
Line 11, “An” should read --an--.
Line 67, “numerals” should read --numerals.--.

COLUMN 4:
Line 32, “belt” should read --belt 7--.

COLUMN 5:
Line 44, “other” should read --the other--.

COLUMN 7:
Line 13, “flows” should read --flow--.

Signed and Sealed this

Twenty-ninth Day of July, 2008

JON W. DUDAS
*Director of the United States Patent and Trademark Office*